United States Patent [19]

Matsuda et al.

[11] Patent Number: 4,598,231

[45] Date of Patent: Jul. 1, 1986

[54] MICROWAVE ION SOURCE

[75] Inventors: Koji Matsuda, Shiga; Toshinori Takagi; Junzo Ishikawa, both of Kyoto, all of Japan

[73] Assignee: Nissin-High Voltage Co. Ltd., Kyoto, Japan

[21] Appl. No.: 524,140

[22] Filed: Feb. 1, 1983

[30] Foreign Application Priority Data

Nov. 25, 1982 [JP] Japan ..... 57-207384

[51] Int. Cl.[4] ..... H01J 7/24; H05B 31/26

[52] U.S. Cl. ..... 315/111.81; 250/423 R; 313/363.1; 313/361.1; 315/39; 315/111.91

[58] Field of Search ..... 315/111.81, 111.91, 315/111.71, 39; 313/363.1, 361.1, 359.1; 250/423 R

[56] References Cited

U.S. PATENT DOCUMENTS

| | | | |
|---|---|---|---|
| 3,363,124 | 1/1968 | Bensussan et al. | 313/361.1 |
| 3,458,743 | 7/1969 | Cleland et al. | 313/363.1 |
| 3,546,513 | 12/1970 | Henning | 313/363.1 |
| 3,778,656 | 12/1973 | Fremiot et al. | 313/363.1 |
| 3,955,118 | 5/1976 | Flemming | 315/111.81 |
| 4,045,677 | 8/1977 | Humphries et al. | 315/111.81 |
| 4,393,333 | 7/1983 | Sakudo et al. | 315/39 |
| 4,409,520 | 10/1983 | Koike et al. | 315/39 |

FOREIGN PATENT DOCUMENTS

| | | | |
|---|---|---|---|
| 2116761 | 7/1972 | France | 313/363.1 |

*Primary Examiner*—Saxfield Chatmon

*Attorney, Agent, or Firm*—Stiefel, Gross, Kurland & Pavane

[57] ABSTRACT

A microwave ion source comprising a discharge chamber provided with an ion source seed material inlet and an ion outlet, a means for radiating microwaves in said discharge chamber, a means for applying a magnetic filed to the inside of said discharge chamber, a means for supplying ion source seed material to said discharge chamber through said ion source seed material inlet and an ion extraction electrode, said ion extraction electrode being made of magnetic material having a resistivity of less than $10^6$ Ωcm and a permeability of more than 5. The present microwave ion source has an improved ion current efficiency.

19 Claims, 4 Drawing Figures

MICROWAVE ION SOURCE

BACKGROUND OF THE INVENTION

1. Field of the Invention

This invention relates to a microwave ion source, and more particularly, a microwave ion source causing electron cyclotron resonance between a microwave and a magnetic field and generating ions by means of a microwave discharge.

2. Description of the Prior Art

Ions generated in a discharge chamber are extracted from the discharge chamber by the electric field of an ion extraction electrode through an ion extraction aperture. However, because some ions move in a direction deviating from the ion-extracting direction, there develop some problems by which their quality of being parallel with each other is deteriorated and the efficiency of making effective the ion current is reduced.

Heretofore, disclosure of microwave ion sources has been made by "N. Sakudo, K. Tokiguchi, H. Koike and I. Kanomata, Rev. Sci. Instrum., Vol. 48, No. 7, p. 762–766, July, 1977" and "N. Sakudo, K. Tokiguchi, H. Koike and I. Kanomata, Inst, Phys. Conf. Ser. No. 54: chapter 2, p. 36–41, 1980".

SUMMARY OF THE INVENTION

An object of the present invention is to provide a microwave ion source offering improved ion current efficiency.

In other words, an object of the present invention is to provide a microwave ion source comprising a discharge chamber provided with an ion source seed material inlet and an ion outlet, a means for radiating microwaves in the discharge chamber, a means for applying a magnetic field to the discharge chamber, a means for supplying ion source seed material to the discharge chamber through the ion source seed material inlet and an ion extraction electrode, the ion extraction electrode being made of magnetic material having a resistivity of less than $10^6\Omega$cm and a permeability of more than 5 to be able to form a magnetic field within a range extending in the ion-extracting direction in an inside space of the discharge chamber and a space provided between the ion outlet and the ion extraction electrode.

In the microwave ion source thus constructed according to the present invention, the ion extraction electrode is made of magnetic material having a resistivity of less than $10^6\Omega$cm and a permeability of more than 5. Needless to say, such a material as this must have sufficient mechanical strength and high temperature resistance. To be concrete, the material should be, for instance, magnetic stainless steel, nickel, ferrite and the like. Non-magnetic stainless steel and molybdenum that have been used for the conventional ion extraction electrode are found by us to be unsuitble for use as a magnetic path. The shape of the ion extraction electrode should be such that the electrode has an aperture for extracting ion beams vis-a-vis the ion outlet and that a magnetic field is produced (or extracted) from the tip of the aperture.

These as well as other features and advantages of the microwave ion source according to the invention will be more fully apparent from the following description and annexed drawings of the presently preferred embodiments therof.

DESCRIPTION OF THE PREFERRED EMBODIMENT

Referring now to the following drawings, the exemplary embodiment of the present invention will be described in detail.

Figure 1:
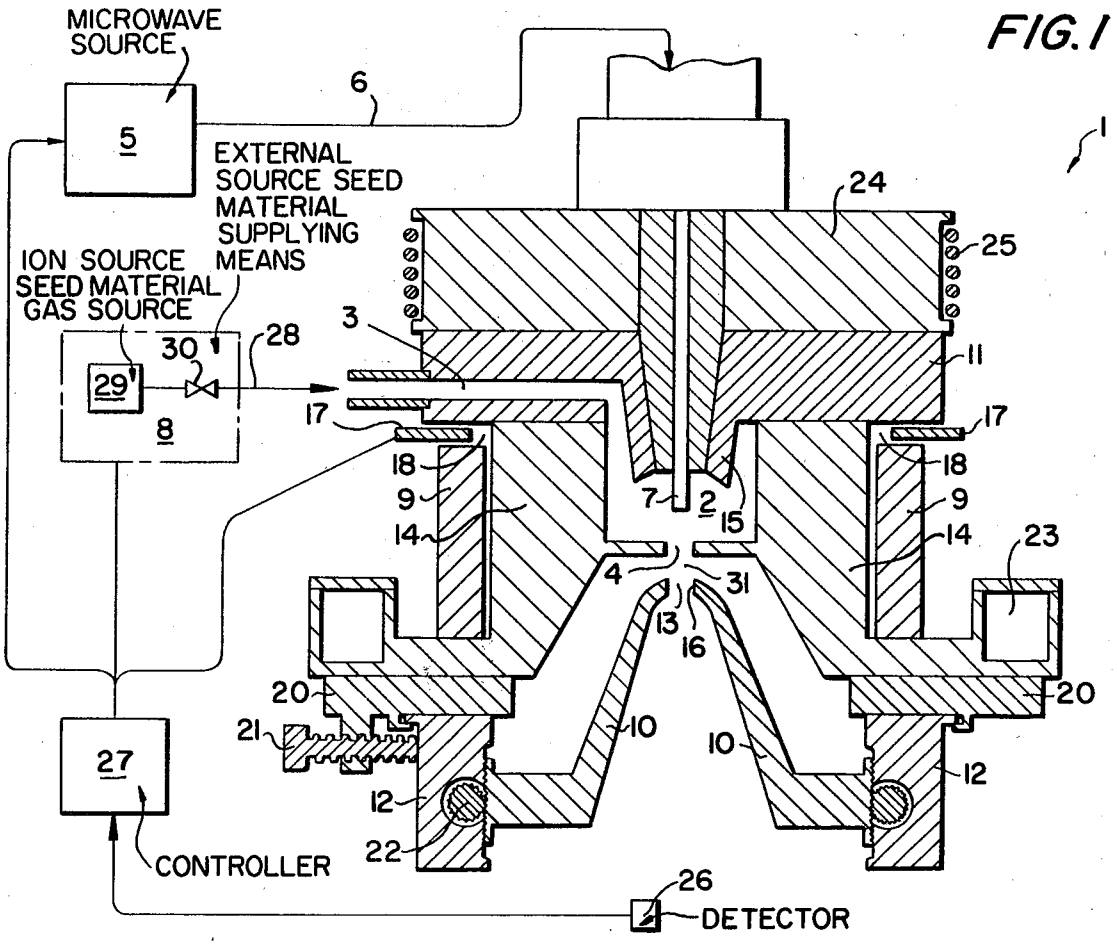
FIG. 1 is a diagrammatic rendition of one example of the microwave ion source embodying the present invention.

In FIG. 1, there is shown an example of the microwave ion source 1 construced according to the present invention. A discharge chamber 2 is provided with an ion source seed material inlet 3 and an ion outlet 4. A microwave generated by a magnetron of a microwave source 5 is supplied to an antenna 7 projected in the discharge chamber 2 through a coaxial tube 6 and emitted from the antenna 7 into the discharge chamber 2. The ion source seed material inlet 3 is connected to an external ion source seed material supplying means 8, so that a gas such as Ar, $BF_3$, $PF_5$ or $AsH_3$ or otherwise B, P, As or the like changed into vapor by means of an oven is supplied to the discharge chamber 2. There are also shown a connection pipe 28, an ion source seed material gas source 29 and a valve 30, the ion source seed material gas source 29 being, for instance, an argon gas bottle or a metal vaporizing oven.

A permanent magnet 9 is installed on the periphery of the discharge chamber to apply a magnetic field to the discharge chamber. Assumed that the magnetic field in the discharge chamber 2 is 875 G when the frequency of the microwave is, 2.45 GHz, electron cyclotron resonance occurs as is generally known, whereas ions are generated. These ions are taken out of the ion outlet 4 of the discharge chamber 2 and diffused, and they become beams because of the electric filed formed by an ion extraction electrode 10, proceeding downward in FIG. 1.

Figure 2:
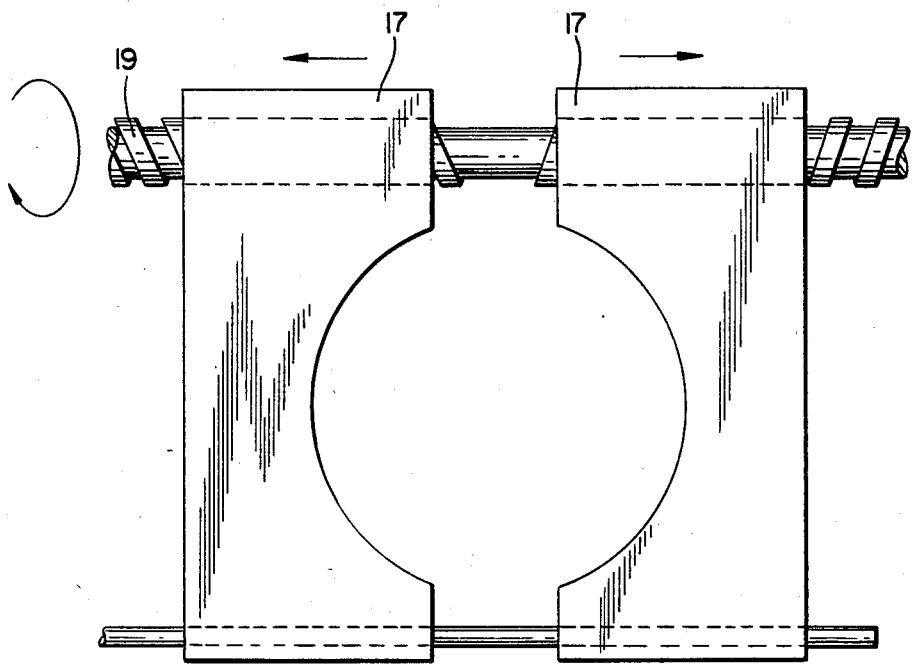
FIG. 2 is a top view of the apparatus shown in FIG. 1, illustrating the principal part of a means for regulating the intensity of the magnetic field.

The formation of a magnetic field is especially important to generate electron cyclotron resonance and to efficiently extract ions. That is, what is necessary is to suitably set the strength and shape of the magnetic filed in the discharge chamber 2. In this apparatus 1, not only a head 11 but also the ion extraction electrode 10 and its transfer mechanism 12 are made of magnetic material (to be concrete, made of magnetic stainless steel, for instance). In addition, the ion extraction electrode 10 is made in the shape of a cone which becomes outwardly wider in the direction opposite to the ion outlet 4 and an aperture 13 facing the ion outlet 4 is provided at the top of the cone. Furthermore, a body 14 is made of non-magnetic material. As a result, the magnetic field is concentrated in a region between the front end 15 of the head and the tip 16 of the ion extraction electrode, that is, in an inside space of the discharge chamber 2 and a space 31 extending from the ion outlet 4 to the ion extraction electrode 10. In other words, this provides a desirable shape extending in an ion-extracting direction without wastefully extending in a direction different from the desirable one to which ions are to proceed. Since a gap 18 is provided to take in and out an adjusting plate 17 made of magnetic material, the intensity of the magnetic field can be properly controlled by changing the degree of inserting the adjusting plate 17 into the gap 18 by turning a screw shaft 19 as shown in FIG. 2.

The ion extraction electrode 10 is attached to an insulating plate 20 fixed to the body 14 in such a way that the electrode 10 is movable through the transfer mechanism 12, so that its position can be elaborately adjusted horizontally and vertically by turning a knob 21 and a gear 22, respectively. By making adjustment to the turning, the stability of ion beams can be improved, while the beam strength is adjustable.

For controlling the temperature of this apparatus 1, coolant is made to flow in a duct 23 annexed to the body 14 and a heater 25 of a heating block 24 is powered. Heating by means of the heating block 24 is of use for preventing impurities contained in ion source seed material or metal vapor employed as ion source seed material from attaching to the wall surface of the discharge chamber 2 and contaminating it. On the other hand, cooling by means of the duct 23 carrying coolant is helpful for protecting from heat, for instance, a vacuum seal between the body 14 and the insulating plate 20.

A controller 27 is used, in proportion to the fluctuation of the output of a detector 26 for detecting the quantity of the ion beam, to control the microwave output of the microwave source 5, the quantity of ion source seed material to be supplied by the ion source seed material supplying means 8, and the intensity of the magnetic field by moving the adjusting plate 17, in order to maintain the predetermined quantity of the ion beam stably.

Figure 3A:
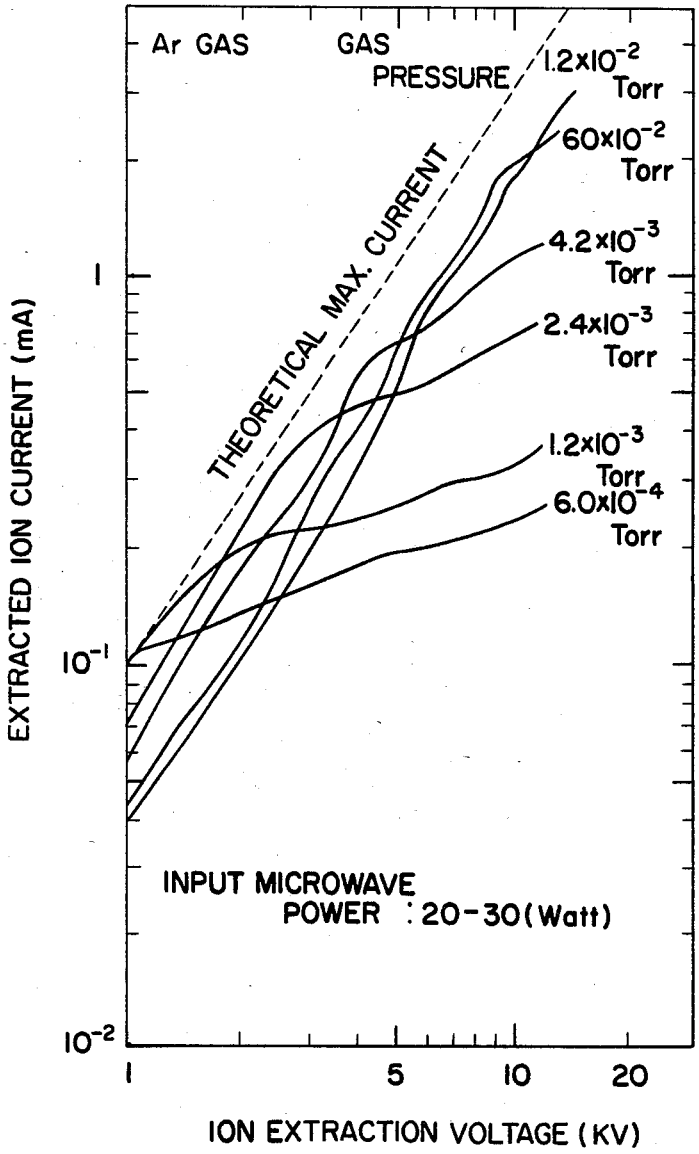
FIGS. 3A and 3B are a graphic representations illustrating test data.
Figure 3B:
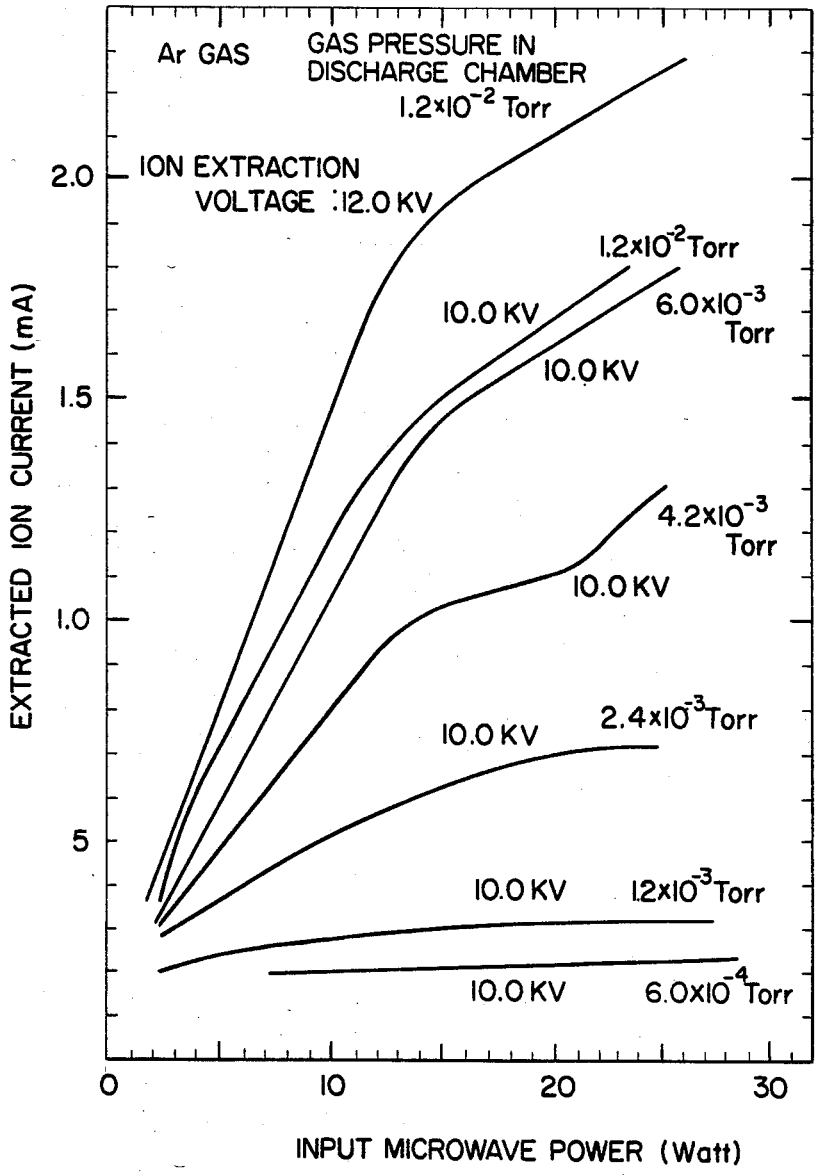

The size of the apparatus 1 except 5, 8, 26 and 27 of FIG. 1 is about 50 mm in diameter and 65 mm in height. FIGS. 3 (A) and (B) show test data when the diameter of the aperture of the ion extraction electrode 10 is assumed 3 mm.

As another example, there is one in which the cylindrical permanet magnet 9 is replaced with a cylindrical solenoid. In this case, the intensity of a magnetic field can be regulated by changing the current for the solenoid. In addition, a plurality of apertures may be provided for an ion extraction electrode.

As has been made clear, the microwave ion source according to the present invention features an ion extraction electrode made of magnetic material and its suitability of being used as a magnetic path.

Accordingly, the magnetic field is concentrated toward the discharge chamber from the ion extraction electrode and at the same time the magnetic reluctance of the magnetic path is reduced. In other words, the efficiency of forming a magnetic field is improved. As a result, a means for applying a magnetic field can be made compact, while power consumption can be economized when a solenoid as a means for applying a magnetic field is employed. It is also possible to use a permanent magnet as a means for applying a magnetic field. In this case, the advantage is that power for generating the magnetic field is unnecessary.

On the other hand, since the shape of the magnetic field becomes the one extended in the ion-extracting direction, it reduces the number of ions proceeding in a direction deviated from the ion-extracting one and almost all ions can be extracted. According to the experiments made by the present inventors, an ion current of 95.5 $mA/cm^2$ could be extracted (not shown in FIGS. 3(A) and (B)). In this connection, the ion current extractable by the microwave ion source of the prior art is approximately 23 $mA/cm^2$. Therefore, the microwave ion source thus constructed according to the present invention obviously demonstrates better performance.

As many apparently widely different embodiments of this invention may be made without departing from the spirit and scope thereof, it is to be understood that the invention is not limited to the specific embodiments thereof except as defined in the appended claims.

What is claimed is:

1. In a microwave ion source comprising a high voltage discharge chamber having an ion source seed material inlet, an ion outlet, means for radiating microwaves in the discharge chamber, means for applying a magnetic field to the discharge chamber, means for supplying an ion source seed material to the discharge chamber through the ion source seed material inlet, and ion extraction means, the improvement comprising:

said ion extraction means comprising a low voltage ion extraction electrode downstream of the ion outlet of the discharge chamber, insulating means separating the low voltage ion extraction electrode and the high voltage discharge chamber, said low voltage ion extraction electrode comprising a magnetic material for defining a magnetic field extending in the ion extraction direction from inside said discharge chamber and out through a space defined between said ion outlet and said low voltage ion extraction electrode.

2. The microwave ion source according to claim 1, wherein the magnetic material has a resistivity of less than $10^6$ ohm-cm and a permeability of more than 5.

3. A microwave ion source as claimed in claim 2, wherein said low voltage ion extraction electrode is made of magnetic stainless steel.

4. A microwave ion source as claimed in claim 2, wherein said low voltage ion extraction electrode is in the shape of a cone that becomes externally wider in the direction opposite to said ion outlet and provided with an aperture facing said ion outlet at the top of the cone.

5. A microwave ion source as claimed in claim 2, wherein said low voltage ion extraction electrode is equipped with a transfer mechanism for adjusting its position relative to said ion outlet.

6. A microwave ion source as claimed in claim 2, wherein the means for applying a magnetic field is a cylindrical permanent magnet installed on the periphery of said discharge chamber.

7. A microwave ion source as claimed in claim 6, wherein said means for applying a magnetic field further provides a means for regulating the intensity of the magnetic field which is a variable magnetic reluctance type and set in a magnetic path.

8. A microwave ion source as claimed in claim 2, wherein said means for applying a magnetic field is a cylindrical solenoid installed on the periphery of said discharge chamber.

9. A microwave ion source as claimed in claim 2, wherein the means for radiating microwaves consists of an antenna allowed to project in said discharge chamber; a microwave source provided outside said discharge chamber; and a coaxial tube connecting said microwave source and said anntena.

10. A microwave ion source as claimed in claim 9, wherein said microwave source is a magnetron.

11. A microwave ion source as claimed in claim 2, wherein said means for supplying ion source seed material consists of an ion source seed material gas source; a pipe connecting said ion source seed material gas source to said ion source seed material inlet; and a valve provided in the middle of said pipe.

12. A microwave ion source as claimed in claim 11, wherein said ion source seed material gas source is an argon gas bottle.

13. A microwave ion source as claimed in claim 11, wherein said ion source seed material gas source is an oven for vaporizing metal.

14. A microwave ion source as claimed in claim 2, wherein said source further comprises a means for heating the wall of said discharge chamber for preventing impurities contained in ion source seed material from attaching to said wall.

15. A microwave ion source as claimed in claim 2, wherein said source is equipped with a detector for detecting the quantity of ion beam and a controller for making constant the quantity of ion beam by controlling the strength of the microwave or the quantity of supplying ion source seed material, or the intensity of a magnetic field in proportion to the fluctuation of the output of said detector.

16. A compact microwave discharge ion source comprising:

a discharge chamber having an ion source seed material inlet and an ion outlet;

a high voltage insulator in front of the ion outlet;

means for radiating microwaves in the discharge chamber, said means comprising an antenna projecting into said discharge chamber, a magnetron and a coaxial tube connecting said antenna to said magnetron;

means for applying a magnetic field to the discharge chamber, said means comprising a cylindrical permanent magnet surrounding the periphery of said discharge chamber and a variable magnetic reluctance means located in the magnetic field formed by said cylindrical permanent magnet for regulating the intensity of the magnetic field;

means for supplying an ion source seed material to the discharge chamber through the ion source seed material inlet, said ion source seed material supply means comprising an ion source seed material gas source, a pipe connecting said ion source seed material gas sourse to said ion source seed material inlet and a valve in said pipe;

ion extraction means, said ion extraction means comprising a low voltage ion extraction electrode located downstream of the ion outlet of the discharge chamber, an insulating means separating the low voltage ion extraction electrode and the high voltage discharge chamber, said low voltage ion extraction electrode comprising a magnetic material having a resistivity of less than $10^6$ ohm-cm and a permeability of more than 5 for defining a magnetic field extending in the ion extracting direction from inside said discharge chamber and out through a space defined between said ion oulet and said low voltage ion extraction electrode, and wherein said low voltage ion extraction electrode comprises a cone-shaped electrode that widens in a direction diverging from said ion outlet and an aperture facing said ion outlet;

transfer means for varying the position of the low voltage ion extraction electrode relative to said ion outlet;

means for heating the wall of said discharge chamber;

detector means for detecting the ion beam strength; and control means for maintaining the ion beam strength constant.

17. The compact microwave discharge ion source according to claim 16, wherein the control means comprises means for controlling the strength of the microwave generated by the microwave radiating means.

18. The compact microwave discharge ion source according to claim 16, wherein the control means comprises means for controlling the flow rate of ion source seed material into the discharge chamber through the ion source seed material inlet.

19. The compact microwave discharge ion source according to claim 16, wherein the control means comprises means for controlling the intensity of the magnetic field generated by the cylindrical permanent magnet in proportion to the fluctuation of the ion beams strength as detected by said detector means.

* * * * *